US006641021B2

(12) United States Patent
Jablonski

(10) Patent No.: US 6,641,021 B2
(45) Date of Patent: Nov. 4, 2003

(54) MAGAZINE RAIL SYSTEM FOR FASTENER-DRIVING TOOL

(75) Inventor: David W. Jablonski, Warrenville, IL (US)

(73) Assignee: Illinois Toolworks Inc., Glenview, IL (US)

( * ) Notice: Subject to any disclaimer, the term of this patent is extended or adjusted under 35 U.S.C. 154(b) by 0 days.

(21) Appl. No.: 10/105,502

(22) Filed: Mar. 25, 2002

(65) Prior Publication Data

US 2003/0178463 A1 Sep. 25, 2003

(51) Int. Cl.[7] ..... B25C 3/00

(52) U.S. Cl. ..... 227/120; 227/109; 227/127; 227/128; 227/129

(58) Field of Search ..... 227/109, 119, 227/120, 127, 128, 135, 136, 139, 150

(56) References Cited

U.S. PATENT DOCUMENTS

| | | | | |
|---|---|---|---|---|
| 3,552,627 | A | | 1/1971 | Moreno |
| 4,197,974 | A | | 4/1980 | Morton et al. |
| 4,326,661 | A | | 4/1982 | Maurer et al. |
| 4,552,297 | A | | 11/1985 | Belanger et al. |
| 4,741,466 | A | | 5/1988 | Birkhofer |
| 4,784,306 | A | | 11/1988 | Baum |
| 4,815,647 | A | * | 3/1989 | Chou ..... 227/109 |
| 4,932,580 | A | * | 6/1990 | Pfister et al. ..... 227/10 |
| 5,220,123 | A | * | 6/1993 | Oehry ..... 89/1.14 |
| 5,368,213 | A | | 11/1994 | Massari, Jr. |
| 5,579,975 | A | * | 12/1996 | Moorman ..... 227/8 |
| 5,605,269 | A | * | 2/1997 | Musiani ..... 227/109 |
| 5,615,819 | A | | 4/1997 | Hou et al. |
| 5,908,148 | A | | 6/1999 | Kochs et al. |
| 6,161,746 | A | | 12/2000 | Wey |
| 6,199,739 | B1 | | 3/2001 | Mukoyama et al. |
| 6,299,046 | B1 | | 10/2001 | Chen |

* cited by examiner

*Primary Examiner*—Scott A. Smith
*Assistant Examiner*—Chukwurah Nathaniel
(74) *Attorney, Agent, or Firm*—Lisa M. Soltis; Mark W. Crow; Donald J. Breh

(57) ABSTRACT

In a fastener-driving tool having a reciprocating driver blade for driving fasteners into a workpiece, a magazine configured for storing and feeding at least one collated strip of fasteners to the driver blade, including a housing defining a feed end, a driving end and a guidance portion disposed between and contacting the two ends, the guidance portion having at least two guidance formations, a first guidance formation configured for engaging the fastener strip at a first location, and the second guidance formation configured for engaging the fastener strip at a second location. In a preferred embodiment, the fastener strip is supported only by the first guidance formation in a first zone of the magazine, and only by the second guidance formation is a second zone of the magazine.

18 Claims, 3 Drawing Sheets

MAGAZINE RAIL SYSTEM FOR FASTENER-DRIVING TOOL

BACKGROUND OF THE INVENTION

This invention relates generally to fastener-driving tools having magazine systems for storing and delivering strips of attached fasteners to a nosepiece where a reciprocating driver blade drives individual fasteners into a workpiece, and more specifically to a magazine rail system for such a tool.

Fastener-driving tools, which may be pneumatically-powered, combustion-powered or powder activated, are widely used for driving fasteners of a type having an elongate shank with a pointed end and a head. Typically, such fasteners are designed to be forcibly driven through a workpiece into a substrate. Such fasteners include nails designed to be forcibly driven into wood and drive pins designed to be forcibly driven into concrete or masonry. Typically, in such drive pins, the shank has a portion flaring outwardly where the shank adjoins the head. An exemplary use of such drive pins is for attaching metal channels, which are used to mount plasterboard walls, or other metal workpieces to concrete substrates.

Many fastener-driving tools require such fasteners to be fed in strips, in which the fasteners are collated, through magazines having mechanisms for feeding the strips of collated fasteners. Commonly, such fasteners are collated via carriers molded from polymeric materials, such as polypropylene, with individual sleeves, bushings, or holders for the respective fasteners, and with frangible bridges between successive sleeves, bushings or holders. Examples of such fasteners collated via such carriers are disclosed in Haytayan U.S. Pat. Nos. 3,927,459; 3,954,176 and 4,106,618; in Whitledge U.S. Pat. No. 4,718,551 and in Steffen et al. U.S. Pat. No. 4,932,821.

U.S. Pat. No. 5,069,340 to Ernst et al., which is incorporated by reference, discloses a strip of fasteners for use with a fastener-driving tool. The strip of fasteners featuring a molded carrier configured so that each fastener is held within a generally cylindrical sleeve. Each sleeve has opposed windows configured to receive corresponding opposed ribs of a fastener-guiding device. Each window is bordered by radially extending upper and lower portions defining a guide channel. Frangible bridges secure adjacent carriers, and their corresponding fasteners, to each other.

One operational condition experienced with prior art fastener strips is that in some cases, strips become misaligned in the magazine. In other words, the fasteners are oriented at an angle other than 90° relative to the workpiece, assuming 90° orientation of the tool. Explained differently, the fastener is oriented in a non-parallel orientation relative to the driver blade prior to driving. If a misaligned strip delivers a misaligned fastener to the nosepiece for impact by the driving blade, the fastener may be improperly driven and/or bend into rigid substrates, causing a bent or "fish-hook" configuration which requires driving of an additional fastener into the workpiece. Obviously, this practice is wasteful of time and materials, and in some cases may spoil the workpiece.

Another operational condition of fastener-driving tools using magazine-fed fastener strips is that in some cases the strips become caught or stuck in the magazine at the rear end of the tool opposite the nosepiece end. One explanation for this stuck condition is that the strips are molded of polymeric material such as polypropylene or equivalent material, the dimensions of which are inherently difficult to control or to maintain within strict tolerances. Especially when the fastener strips are guided solely by rails engaging the opposing strip windows as described above, it may be difficult for the operator to efficiently insert strips and obtain optimum alignment. Thus, the magazine loading operation may become unduly time consuming and potentially frustrating to the operator.

One attempted solution to this problem is that the magazine may be constructed with rails which engage only bottom surfaces of the fastener-holding strip sleeves. While this alternative promotes easy loading, it does not maintain the proper alignment of fasteners just prior to their being driven by the driver blade. Thus, misaligned or "fish hooked" fasteners may result from this arrangement.

Another disadvantage of a magazine configured to engage the lower ends of the fastener holding strip sleeves is that when the tool is operated in an inverted position, such as when operators operate the tool for driving fasteners overhead, the fasteners become vertically misaligned in the magazine and cannot be properly engaged by the driver blade.

Accordingly, a first object of the present invention is to provide an improved fastener-driving tool magazine which facilitates easy loading of fastener strips.

Another object of the present invention is to provide an improved fastener-driving tool magazine which enhances fastener alignment relative to the driver blade.

Yet another object of the present invention is to provide an improved fastener-driving tool which facilitates alignment of the fastener strip when the tool is used in a variety of positions, including inverted.

BRIEF SUMMARY OF THE INVENTION

The above-listed objects are met or exceeded by the present magazine rail system, which features a dual portion guidance system for collated fastener strips. A first portion of the magazine is configured for easy loading of fastener strips and engages the strips at lower ends of the sleeves. At a designated portion of the magazine, a second portion of the guidance system engages the fastener strip in the window portion of each sleeve for facilitating proper alignment prior to engagement with the driver blade.

More specifically, the present invention provides, in a fastener-driving tool having a reciprocating driver blade for driving fasteners into a workpiece, a magazine configured for storing and feeding at least one collated strip of fasteners to the driver blade, including a housing defining a feed end, a driving end and a guidance portion disposed between and contacting the two ends. The guidance portion has at least two guidance formations, a first guidance formation configured for engaging the fastener strip at a first location, and a second guidance formation configured for engaging the fastener strip at a second location.

Each fastener strip includes a plurality of sleeves having a lower edge and a window channel defined by at least one and preferably two opposing radially projecting portions, and the first guidance formation is configured for engaging the strip at the lower edge, and the second guidance formation is configured for engaging the strip in the window channel. Preferably, the fastener strip is supported only by the first guidance formation in a first zone of the magazine, and only by the second guidance formation is a second zone of the magazine.

In another embodiment, a fastener driving tool has a magazine including a housing having a first guidance formation and a second guidance formation, the first guidance formation configured for guiding a fastener strip in a first location, the second guidance formation configured for guiding the fastener strip in a second location, the first location being different from the second location. In the preferred embodiment, the housing is configured so that the fastener strip is guided first only by the first guidance formation, then only by the second guidance formation.

DETAILED DESCRIPTION OF THE INVENTION

Figure 1:
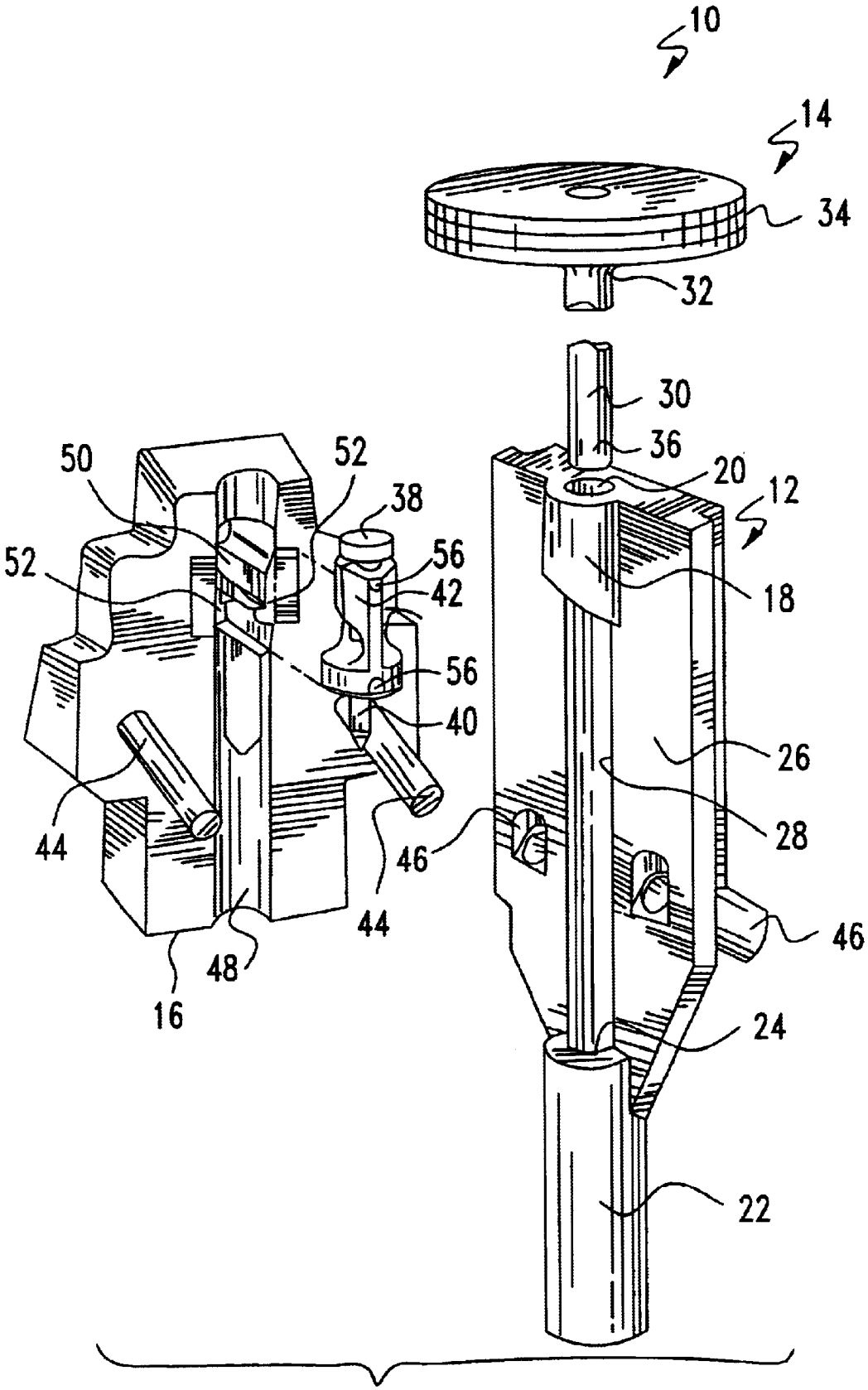
FIG. 1 is an exploded fragmentary exploded perspective view of components of a fastener-driving tool suitable for use with the present magazine.

Referring now to FIG. 1, a fastener driving tool 10 is designated generally and may be combustion-powered, pneumatic-powered or powder-activated, however, in the preferred embodiment a combustion-powered tool is depicted. Illustrated components of the tool 10 include a nosepiece 12, a driving mechanism 14 and a guiding device 16. Other components of the fastener-driving tool 10 are not critical to this invention and may be well known components of such a tool. A combustion-powered, fastener-driving tool available from ITW-Paslode (a unit of Illinois Tool Works, Inc.) of Lincolnshire, Ill., under its IMPULSE trademark is a preferred tool, into which these components can be readily incorporated. Such combustion-powered tools are similar to the tools disclosed in U.S. Pat. Nos. 4,403,722; 4,483,280; 4,483,474; 4,483,474; 4,522,162; 5,263,439 and Re. 32,452; all of which are incorporated by reference.

The nosepiece 12 is similar to nosepieces of conventional fastener-driving tools 10 and is preferably machined from a steel casting to have an upper tubular portion 18 defining a generally cylindrical bore 20, a lower tubular portion 22 having generally tubular bore 24, and a wall 26 extending between the bores 20, 24. In the preferred embodiment, the tubular bores are axially aligned. A generally semi-circular groove 28 is aligned with the bores 20, 24 and defines a pathway for a reciprocating driver blade 30 which is secured at its upper end 32 to a piston 34. The driver blade 30 and the piston 34 make up the driving mechanism 14. The piston 34 and the driver blade 30 are arranged in a known manner to be jointly and forcibly driven by compressed air or combustion product within a cylinder of the tool, as is well-known in the art. A distal end 36 of the driver blade 30 is constructed and arranged to strike a head 38 of a fastener 40 to drive the fastener and its associated sleeve 42 forcibly through the bore 24. In the preferred embodiment, the fasteners 40 are pins designed to be driven into concrete for retaining wallboard tracking in place, however it is contemplated that any type of conventional collated fastener suitable for use in a fastener-driving tool could be used with the present magazine.

The guiding device 16, which is preferably machined from a steel casting, preferably has at least one steel pin 44 to project at an angle from the device 16 and matingly engage a respective socket 46 in the nosepiece 12. In the preferred embodiment, a pair of pins 44 and a pair of respective sockets 46 are provided, however the number and arrangement of pins and sockets may vary to suit the application. This mating engagement allows the guiding device 16 against the nosepiece 12 in an operative position in which the guiding device is secured to the nosepiece by other structures (not shown) which are well known in the art. A feature of the guiding device 16 is a generally semi-circular groove 48 which matches the groove 28 in the nosepiece 12 to complete the definition of the fastener pathway by the nosepiece described above.

Another feature of the guiding device 16 is an aperture 50 which opens into the groove 48 and which is configured to permit or accommodate any one fastener 40 and its associated sleeve 42 to pass through the aperture into the groove. In addition, the guiding device 16 has a pair of generally parallel ribs 52 provided by relatively hardened steel inserts on opposite sides of the aperture 50. The construction and arrangement of the fasteners 40 and the sleeves 42 are described in great detail in U.S. Pat. No. 5,069,340, which is incorporated by reference, and will be described below as needed to describe the operation of the present magazine.

Figure 2:
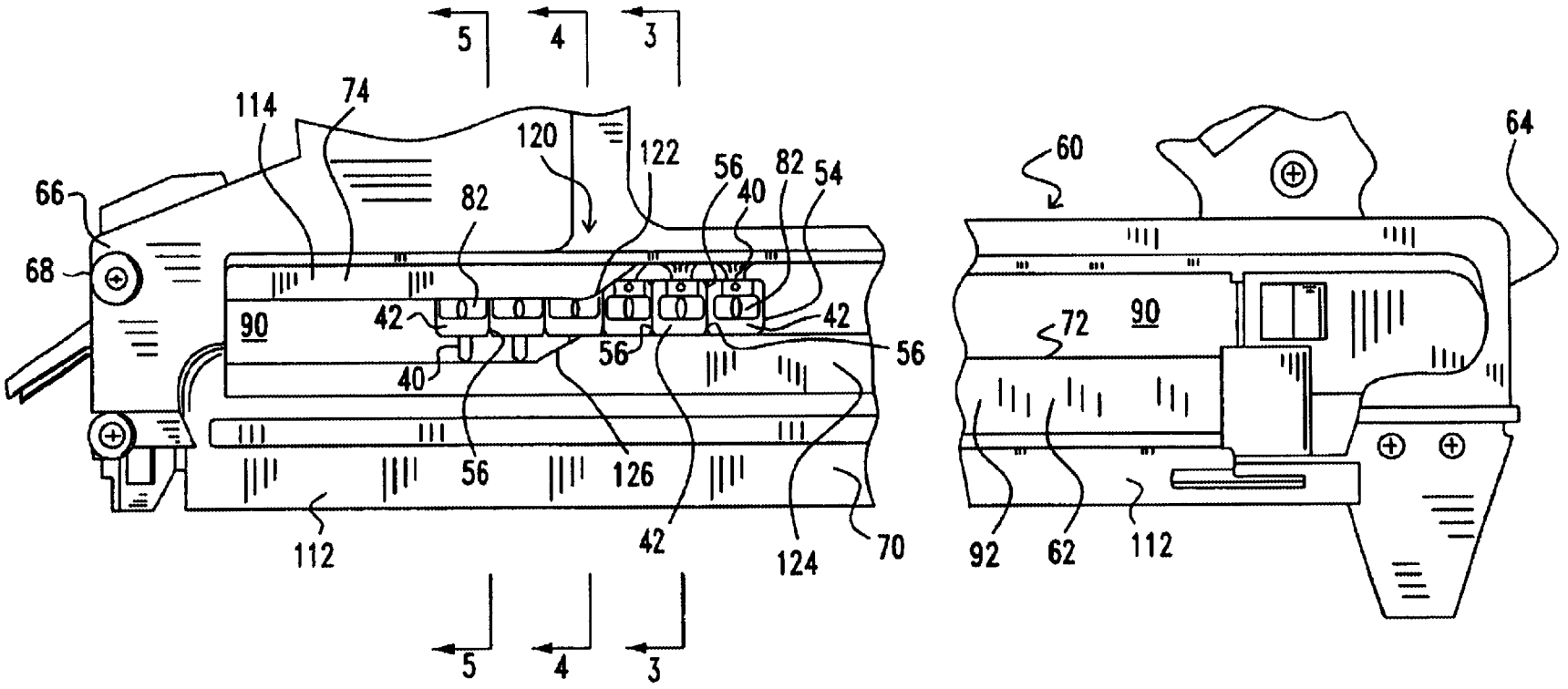
FIG. 2 is a side elevational view of the present magazine.
Figure 5:
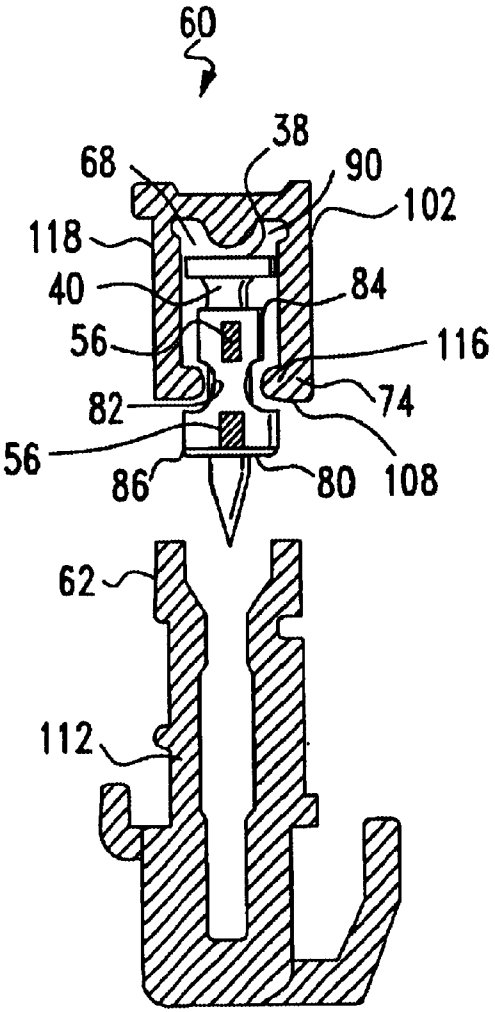
FIG. 5 is a vertical cross-section taken along the line 5—5 of FIG. 2 and in the direction generally indicated.
Figure 4:
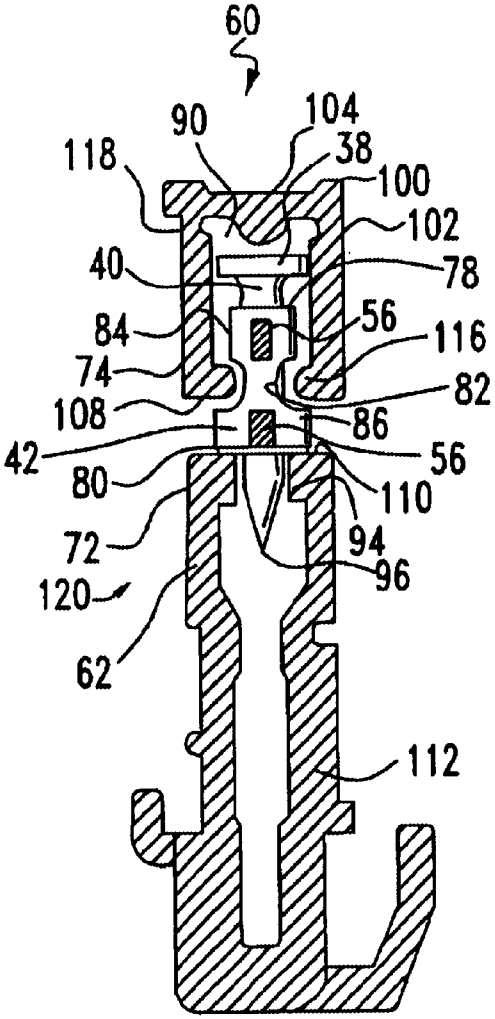
FIG. 4 is a vertical cross-section taken along the line 4—4 of FIG. 2 and in the direction generally indicated.
Figure 3:
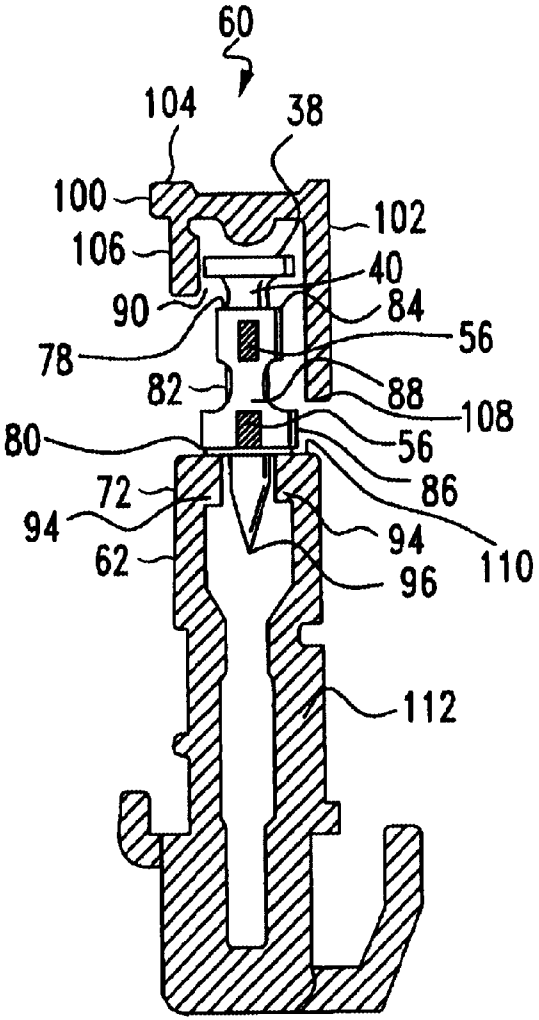
FIG. 3 is a vertical cross-section taken along the line 3—3 of FIG. 2 and in the direction generally indicated.

Referring now to FIGS. 1 and 2, the guiding device 16 is configured to receive a carrier or strip 54 of collated fasteners 40 secured to each other by frangible bridges 56 preferably integrally molded to adjacent sleeves 42. As is well known in the art, the downward movement of the driver blade 30 in the groove 28, 48 impacts a single fastener 40 and severs the fastener and its associated sleeve 42 from the strip 54, by breaking the bridges 56. The strip 54 is delivered to the guiding device 16 by a magazine, generally designated 60 which feeds the strip 54 longitudinally to the guiding device 16 as is known in the art.

As is described above, an important object of the present invention is to provide the magazine 60 which addresses problems encountered in prior art magazines in feeding strips 54 of fasteners 40 to the aperture 50 in an efficient and obstacle-free manner. More specifically, as will be seen below, the present magazine 60 achieves its goals by providing a dual guidance system for guiding the strips 54 of fasteners 40 toward the aperture 50.

Referring now to FIGS. 2–5, the magazine 60 includes a housing 62 defining a feed end 64 defining a slot-like opening (not shown) through which the strips 54 of the fasteners 40 are inserted, a driving end 66 defining an exit opening 68 (best seen in FIG. 5) which is in alignment or registry with the aperture 50 (shown in FIG. 1) to allow free sequential passage of the fasteners 40 and sleeves 42 therethrough. Between the feed end 64 and the driving end 66 and contacting the two ends is a guidance portion 70. An important feature of the guidance portion 70 is that it is provided with at least two guidance formations, a first guidance formation 72 configured for engaging the fastener strip 54 at a first location on the strip, and a second guidance formation 74 configured for engaging the fastener strip at a second location.

It is important to note that the present magazine 60 is designed primarily to address operational characteristics of the fastener strip 54, which is described in detail in commonly-assigned U.S. Pat. No. 5,069,340, and is incorporated by reference. The strip 54 includes a linear array of the molded sleeves 42, each defining a vertical bore 78 for accommodating one of the fasteners 40. Each sleeve 42 has a lower edge 80 and a window channel 82 defined by at least one and preferably two opposing radially projecting portions 84, 86. The upper annular portion 84 is integrally joined to the lower portion 86 and the window channel 82 is defined in part by a recessed, preferably concave portion 88 (best seen in FIG. 3). The window channel 82 is so named because the configuration of the recessed portion 88 is such that it communicates with the vertical bore 78 of the sleeve 42.

As discussed in detail in U.S. Pat. No. 5,069,340, the upper annular portion 84 is configured to break or collapse during the driving of the fastener 40. Also, in the preferred embodiment, the upper portion 84 has a smaller diameter than the lower portion 86. However, it is contemplated that the sleeve 42 may have a variety of configurations of the window channel 82, the upper and lower portions 84, 86 as well as the concave portion 88 depending on the application. At a minimum, the channel 82 should have sufficient structure to be slidingly engaged by an elongate rib as described below such that vertical movement of the fastener strip is restricted and maintained for proper alignment with the fastener aperture 50.

Adjacent sleeves 42 are connected to each other by the preferably integrally molded, frangible bridges 56 which are configured to easily break once the forward-most fastener 40 in the strip 54 is engaged in the grooves 28, 48 and is impacted by the driver blade 30. There are various known structural configurations suitable for causing the frangibility of the bridges 56, including but no limited to slits, grooves, perforations, lighter weight material, cutouts and the like.

An important feature of the present magazine 60 is the ability to facilitate loading of the strips 54 at the feed end 64 so that the strips do not become caught on the magazine, and also properly guiding the strips to the fastener aperture 50 in the nosepiece 12. To that end, the magazine 60 defines a fastener passageway 90 which extends the full length of the magazine from the feed end 64 to the driving end 66. A first guidance zone or portion 92 incorporates the first guidance formation 72, begins at the feed end 64 and is configured for engaging the strip 54 at the lower sleeve edge 80.

While alternative configurations are contemplated, the first guidance formation 72 is formed from at least one and preferably a pair of opposing rails 94 projecting laterally into the fastener passageway 90 to provide a track for the fastener. The lower sleeve edge 80 slidably rides on the track, and a lower portion 96 of the fastener 40 protrudes vertically between the rails 94. In the preferred embodiment, strip alignment is maintained by the spacing of the rails 94, which allow limited lateral movement of the fasteners, and correspondingly, the strip 54. At the upper end or head 38 of the fastener 40, lateral misalignment or tipping is prevented by an upper portion 100 of the magazine. An inverted, "L"-shaped channel formation is defined by a long sidewall 102, a top wall 104 and a short sidewall 106 (best seen in FIG. 3). Opposing, preferably parallel portions of the sidewalls 102, 106 provide lateral alignment or "anti-tipping" guidance to the fastener head 38. The fastener passageway 90 is defined in part by opposing end surfaces 108, 110 of the upper magazine end portion 100 and a lower magazine end portion 112.

An important feature of the present invention is the guidance provided to the strip 54, as opposed to any guidance provided to the fastener 40. At the feed end 64, the guidance is the sliding engagement with the lower sleeve edge 80 and an upper end surface 110 of the rails 94. This engagement has been found to provide sufficient slidability of the strips 54 to promote loading and to hinder strips becoming caught in the passageway 90. However, it has also been found that additional alignment guidance is beneficial at the driving end 66 to promote efficient operation of the tool 10.

Accordingly, another feature of the present magazine 60 is that a second guidance zone or portion 114 of the magazine provides the second guidance formation 74 which engages the strip 54 at a distinct location on the strip as compared to the first guidance formation 72. In the preferred embodiment (best seen in FIG. 5), the second guidance formation 74 engages the window channel 82 and the second guidance portion 114 is configured to extend from a location near the driving end 66 of the magazine 60 toward, but not reaching the feed end 64.

To achieve the benefits of both types of guidance formations 72, 74, it is preferred that the second guidance portion 114 extend only about ⅓ the length of the magazine 60, or a sufficient length to accommodate approximately 1¼ standard 10-fastener strips 54. This length provides a good transition for adjacent engagement of multiple and partial strips 54. Conversely, the first guidance portion 92 preferably extends approximately ⅔ the length of the magazine 60.

The second guidance formation 74 preferably takes the form of laterally projecting window channel-engaging rails 116. An important design criterion for the formation 74 is that the rails 116 project inwardly in pincer-like fashion into the fastener passageway 90. The short sidewall 106 is replaced by a long sidewall 118 so that the sidewalls 102, 118 are approximately equal in height. It is preferred that the window channel-engaging rails 116 are spaced from each other to permit free slidability of the strip 54 lengthwise along the passageway 90, but only permitting slight side-to-side movement of the strip. By engaging the window channels 82, the strip 54 is maintained in sufficient alignment for engagement with the fastener aperture 50 (shown in FIG. 1) of the nosepiece 12 (shown in FIG. 1). As such, there is no need to extend the first guidance formation 72 to the driving end 66.

Thus, a feature of the present invention is that each sleeve 42 of the fastener strip 54 is supported only by the first guidance formation 72 in the first guidance portion 92 of the magazine, and only by the second guidance formation 74 in a second portion 114 of the magazine 60. As will be seen in FIGS. 2 and 4, the two portions 92, 114 overlap or form a transition zone 120 where both formations 72 and 74 briefly engage the strip 54. In other words, a single sleeve 42 at a time will be engaged by both formations 72 and 74 as the second guidance formation replaces the first formation as the sole sleeve guidance mechanism.

An advantage of the support and guidance provided by the second portion 114 is that the strip 54 is properly aligned for engagement in the fastener aperture 50. This alignment is maintained even when the tool 10 is used in an inverted position, which may cause the strip 54 to shift in the passageway 90.

As an option, the magazine 60 may be provided with a visual indicator of the guidance zones 92, 114 and the corresponding formations 72, 74. As is seen in FIG. 2, the first zone 92 lacks the long upper sidewall 118 until the transition zone 120. A radiused edge 122 marks the beginning of the sidewall 118 and the end of the edge marks the transition zone 120. Similarly, an outer sidewall 124 forming the first guidance portion 92 ends with a radiused edge 126 ending at the transition zone 120. The intersection of the two radiused edges 122, 126 marks the transition zone 120 and forms an "S"-curve when viewed from the side, thus providing a visual indication of the location of the transition zone.

While specific embodiments of the magazine rail system for a fastener driving tool of the present invention have been shown and described, it will be appreciated by those skilled in the art that changes and modifications may be made thereto without departing from the invention in its broader aspects and as set forth in the following claims.

What is claimed is:

1. In a fastener-driving tool having a reciprocating driver blade for driving fasteners into a workpiece, a magazine configured for storing and feeding at least one collated strip of fasteners to the driver blade, comprising:

a housing defining a feed end, a driving end and a guidance portion disposed between and contacting the two ends;

said guidance portion having at least two guidance formations, a first guidance formation configured for engaging the fastener strip at a first location, and said second guidance formation configured for engaging the fastener strip at a second location;

each fastener strip includes a plurality of sleeves having a lower edge and a window channel defined by at least one radially projecting portion, said first guidance formation is configured for engaging the strip at the lower edge and said second guidance formation is configured for engaging the strip in the window channel.

2. The tool of claim 1 wherein the fastener strip is supported only by said first guidance formation in a first zone of the magazine, and only by said second guidance formation is a second zone of the magazine.

3. The tool of claim 1 wherein said first guidance formation extends from said feed end and said second guidance formation extends from said driving end.

4. The tool of claim 3 wherein said magazine is provided with a transition zone where said first guidance formation ends and said second guidance formation begins.

5. The tool of claim 4 wherein said magazine is provided with at least one sidewall which visually displays said transition zone.

6. The tool of claim 5 wherein said at least one sidewall defines an "S"-curve for indicating said transition zone.

7. The tool of claim 3 wherein said first guidance formation extends approximately ⅔ the length of said magazine.

8. The tool of claim 1 wherein said first guidance formation is at least one rail which engages the bottom of said sleeve.

9. The tool of claim 1 wherein said second guidance formation is a pair of opposing rails which each engage a corresponding set of windows in the fastener strip.

10. A fastener driving tool having a magazine comprising:

a housing having a first guidance formation and a second guidance formation, said first guidance formation configured for guiding a fastener strip in a first location, said second guidance formation configured for guiding the fastener strip in a second location, the first location being different from the second location, wherein said housing is configured so that the fastener strip is guided first only by said first guidance formation, then only by said second guidance formation.

11. The magazine of claim 10 wherein the fastener strip includes a plurality of frangible sleeves each having a lower edge and a window channel, said first guidance formation being configured for slidably engaging said lower edge, said second guidance formation being configured for slidably engaging said window channel.

12. The magazine of claim 10 further including a sidewall configured for indicating a transition zone between said first guidance portion and said second guidance portion.

13. In a fastener-driving tool having a reciprocating driver blade for driving fasteners into a workpiece, a magazine configured for storing and feeding at least one collated strip of fasteners to a nosepiece reciprocally engaged by the driver blade and having a fastener receiving aperture, said magazine comprising:

a housing defining a feed end, a driving end opposite the feed end, said driving end having an opening in communication with the aperture of the nosepiece;

said feed end having a guidance formation configured for engaging said collated strip of fasteners at opposing channel formations for guiding the strip of fasteners into said opening, said guidance formation being the only guidance formation engaging the fastener strip.

14. In a fastener-driving tool having a reciprocating driver blade for driving fasteners into a workpiece, a magazine configured for storing and feeding at least one collated strip of fasteners to the driver blade, comprising:

a housing defining a feed end, a driving end and a guidance portion disposed between and contacting the two ends;

said guidance portion having at least two guidance formations, a first guidance formation configured for engaging the fastener strip at a first location, and said second guidance formation configured for engaging the fastener strip at a second location, wherein said first guidance formation extends from said feed end and said second guidance formation extends from said driving end.

15. The tool of claim 14 wherein said magazine is provided with a transition zone where said first guidance formation ends and said second guidance formation begins.

16. The tool of claim 15 wherein said magazine is provided with at least one sidewall which visually displays said transition zone.

17. The tool of claim 16 wherein said at least one sidewall defines an "S"-curve for indicating said transition zone.

18. The tool of claim 14 wherein said first guidance formation extends approximately ⅔ the length of said magazine.

* * * * *